US011215176B2

(12) United States Patent
Boll et al.

(10) Patent No.: US 11,215,176 B2
(45) Date of Patent: Jan. 4, 2022

(54) SYSTEM INCLUDING RECOVERY PUMP AND VACUUM PUMP

(71) Applicant: MILWAUKEE ELECTRIC TOOL CORPORATION, Brookfield, WI (US)

(72) Inventors: Alex H. Boll, Milwaukee, WI (US); Aaron C. Grode, Germantown, WI (US); Ryan J. Denissen, Sussex, WI (US); Justin Miller, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 187 days.

(21) Appl. No.: 16/510,753

(22) Filed: Jul. 12, 2019

(65) Prior Publication Data

US 2020/0018307 A1 Jan. 16, 2020

Related U.S. Application Data

(60) Provisional application No. 62/697,767, filed on Jul. 13, 2018.

(51) Int. Cl.

| | |
|---|---|
| ***F04B 53/04*** | (2006.01) |
| ***F04B 17/03*** | (2006.01) |
| ***F25B 30/02*** | (2006.01) |

(52) U.S. Cl.

CPC ..... *F04B 53/04* (2013.01); *F04B 17/03* (2013.01); *F25B 30/02* (2013.01); (Continued)

(58) Field of Classification Search

CPC ..... F25B 45/00; F25B 2345/002; F25B 2345/007; F04B 17/03; F04B 2203/0208; F04B 2207/047

See application file for complete search history.

(56) References Cited

U.S. PATENT DOCUMENTS 4,441,330 A 4/1984 Lower et al.
4,805,416 A 2/1989 Manz et al.
(Continued)

FOREIGN PATENT DOCUMENTS

KR 10-1727540 B1 4/2017

OTHER PUBLICATIONS

International Search Report and Written Opinion for Application No. PCT/US2019/041714 dated Oct. 25, 2019 (19 pages).

*Primary Examiner* — Patrick Hamo
(74) *Attorney, Agent, or Firm* — Michael Best & Friedrich LLP

(57) ABSTRACT

A system attachable to a refrigeration circuit includes a recovery pump attachable to the refrigeration circuit to remove refrigerant. The recovery pump includes a pump, an electric motor, a battery pack, and a recovery pump controller for controlling the operation of the electric motor. The recovery pump controller has a first communication interface. The system further includes an accessory attachable to the refrigeration circuit concurrently with the recovery pump. The accessory includes a sensor for detecting a characteristic value of the refrigeration circuit, and an accessory controller electrically connected with the sensor to receive a signal corresponding with the characteristic value of the refrigeration circuit. The accessory controller has a second communication interface to communicate the signal to the recovery pump controller via the first and second wireless interfaces. The recovery pump controller controls the operation of the electric motor based upon the signal received from the accessory.

27 Claims, 8 Drawing Sheets

(52) U.S. Cl.
CPC . *F04B 2203/0208* (2013.01); *F04B 2207/047* (2013.01); *F25B 2300/00* (2013.01); *F25B 2345/002* (2013.01); *F25B 2700/00* (2013.01)

(56) References Cited

U.S. PATENT DOCUMENTS

| | | | | |
|---|---|---|---|---|
| 5,875,638 | A | 3/1999 | Tinsler | |
| 9,018,879 | B2 * | 4/2015 | Watanabe | G01K 13/00 318/472 |
| 2013/0319025 | A1 * | 12/2013 | Wagaman | B60H 1/00585 62/149 |
| 2018/0128529 | A1 | 5/2018 | Chen et al. | |

* cited by examiner

SYSTEM INCLUDING RECOVERY PUMP AND VACUUM PUMP

CROSS-REFERENCE TO RELATED APPLICATIONS

This application claims benefit to U.S. Provisional Patent Application No. 62/697,767 filed Jul. 13, 2018, the entire content of which is incorporated herein by reference.

FIELD OF THE INVENTION

The present invention relates to pumps, and more particularly to recovery and vacuum pumps for refrigeration and air-conditioning systems.

SUMMARY OF THE INVENTION

The invention provides, in one aspect, a system attachable to a refrigeration circuit includes a recovery pump attachable to the refrigeration circuit to remove refrigerant therefrom. The recovery pump includes a pump, an electric motor for driving the pump, a battery pack for providing power to the electric motor, and a recovery pump controller for controlling the operation of the electric motor. The recovery pump controller has a first communication interface. The system further includes an accessory attachable to the refrigeration circuit concurrently with the recovery pump. The accessory includes a sensor for detecting a characteristic value of the refrigeration circuit, and an accessory controller electrically connected with the sensor to receive a signal therefrom corresponding with the characteristic value of the refrigeration circuit. The accessory controller has a second communication interface to communicate the signal to the recovery pump controller via the first and second wireless interfaces. The recovery pump controller is operable to control the operation of the electric motor based upon the signal received from the accessory.

The invention provides, in another aspect, a system attachable to a refrigeration circuit includes a recovery pump attachable to the refrigeration circuit to remove refrigerant therefrom. The recovery pump includes a pump, an electric motor for driving the pump, and a recovery pump controller for controlling the operation of the electric motor. The recovery pump controller has a first communication interface. The system further includes an accessory attachable to the refrigeration circuit concurrently with the recovery pump. The accessory includes a sensor for detecting a characteristic value of the refrigeration circuit, and an accessory controller electrically connected with the sensor to receive a signal therefrom corresponding with the characteristic value of the refrigeration circuit. The accessory controller has a second communication interface to communicate the signal to the recovery pump controller via the first and second communication interfaces. The recovery pump controller is operable to control the operation of the electric motor based upon the signal received from the accessory. The accessory includes at least one of an electrically actuated fluid valve coupled between the pump and the refrigeration circuit to selectively place the pump in fluid communication with the refrigeration circuit, or a gauge accessory that is attachable to the refrigeration circuit and is disposed remotely from the recovery pump. The signal being indicative of the pressure within the refrigeration circuit proximate the gauge accessory.

The invention provides, in another aspect, a system attachable to a refrigeration circuit includes a vacuum pump attachable to the refrigeration circuit to remove fluid therefrom. The vacuum pump includes a pump, an electric motor for driving the pump, and a vacuum pump controller for controlling the operation of the electric motor. The vacuum pump controller having a first communication interface. The system further includes an accessory attachable to the refrigeration circuit concurrently with the vacuum pump. The accessory includes at least one of an electrically actuated fluid valve coupled between the pump and the refrigeration circuit to selectively place the pump in fluid communication with the refrigeration circuit, or a gauge accessory attachable to the refrigeration circuit concurrently with the vacuum pump. The gauge accessory includes a sensor for detecting pressure within the refrigeration circuit, and an accessory controller electrically connected with the sensor to receive a signal therefrom corresponding with the pressure of the refrigeration circuit. The accessory controller has a second communication interface to communicate the signal to the vacuum pump controller via the first and second communication interfaces. The vacuum pump controller is operable to control the operation of the electric motor based upon the signal received from the gauge accessory.

The invention provides, in another aspect, a system including a recovery pump attachable to a refrigeration circuit to remove refrigerant therefrom. The recovery pump includes a pump, an electric motor for driving the pump, a battery pack for providing power to the electric motor, and a recovery pump controller for controlling the operation of the electric motor. The recovery pump controller has a communication interface. The system includes a vacuum pump attachable to the refrigeration circuit concurrently with the recovery pump to create a vacuum in the refrigeration circuit. The vacuum pump includes a pump, an electric motor for driving the pump, a battery pack for providing power to the electric motor, and a vacuum pump controller for controlling the operation of the electric motor. The vacuum pump controller has a communication interface. The recovery pump controller and the vacuum pump controller are capable of bi-directional communication via the respective communication interfaces to control operation of the electric motors in the respective recovery pump and the vacuum pump.

The invention provides, in another aspect, a system attachable to a refrigeration circuit. The system includes a recovery pump attachable to the refrigeration circuit to remove refrigerant therefrom. The recovery pump includes a first pump, a first electric motor for driving the first pump, and a first battery pack for providing power to the first electric motor. The system further includes a vacuum pump attachable to the refrigeration system to create a vacuum therein. The vacuum pump includes a second pump, a second electric motor for driving the second pump, a second battery pack for providing power to the second electric motor. The first and second battery packs are interchangeable to provide power to the recovery pump and the vacuum pump.

The invention provides, in another aspect, a system attachable to a refrigeration circuit includes a pump assembly attachable to the refrigeration circuit. The pump assembly includes a pump, an electric motor for driving the pump, and a pump controller for controlling the operation of the electric motor. The pump controller having a first communication interface. The system further includes an accessory attachable to the refrigeration circuit concurrently with the pump assembly. The accessory includes a sensor for detecting a characteristic value of the refrigeration circuit, and an accessory controller electrically connected with the sensor to receive a signal therefrom corresponding with the characteristic value of the refrigeration circuit. The accessory controller having a second communication interface. The system further includes a communication hub configured to receive the signal from the second communication interface of the accessory and transmit the signal to the pump controller via the first communication interface. The pump controller is operable to control the operation of the electric motor based upon the signal received from the communication hub.

The invention provides, in another aspect, a recovery pump for use with a refrigeration circuit. The recovery pump includes a pump, an electric motor for driving the pump, a battery pack for providing power to the electric motor, and a controller for controlling the operation of the electric motor. The controller includes a communication interface for communicating at least one of a performance parameter of the recovery pump to a user or a characteristic value associated with the refrigeration circuit to a user.

The invention provides, in another aspect, a vacuum pump for use with a refrigeration circuit. The vacuum pump includes a pump, an electric motor for driving the pump, a battery pack for providing power to the electric motor, and a controller for controlling the operation of the electric motor. The controller includes a communication interface for communicating at least one of a performance parameter of the vacuum pump to a user or a characteristic value associated with the refrigeration circuit to a user.

The invention provides, in another aspect, a method of performing work on a refrigeration circuit includes connecting a recovery pump, a vacuum pump, and an electrically actuated fluid valve to the refrigeration circuit, operating the recovery pump in a fluid removal state, in which the recovery pump removes the refrigerant from the refrigeration circuit, wirelessly communicating a first notification to a portable computer in response to termination of the fluid removal state, and wirelessly communicating an instruction via the portable computer to actuate the electrically actuated fluid valve to isolate the recovery pump from the refrigeration circuit and to place the vacuum pump in fluid communication with the refrigeration circuit.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
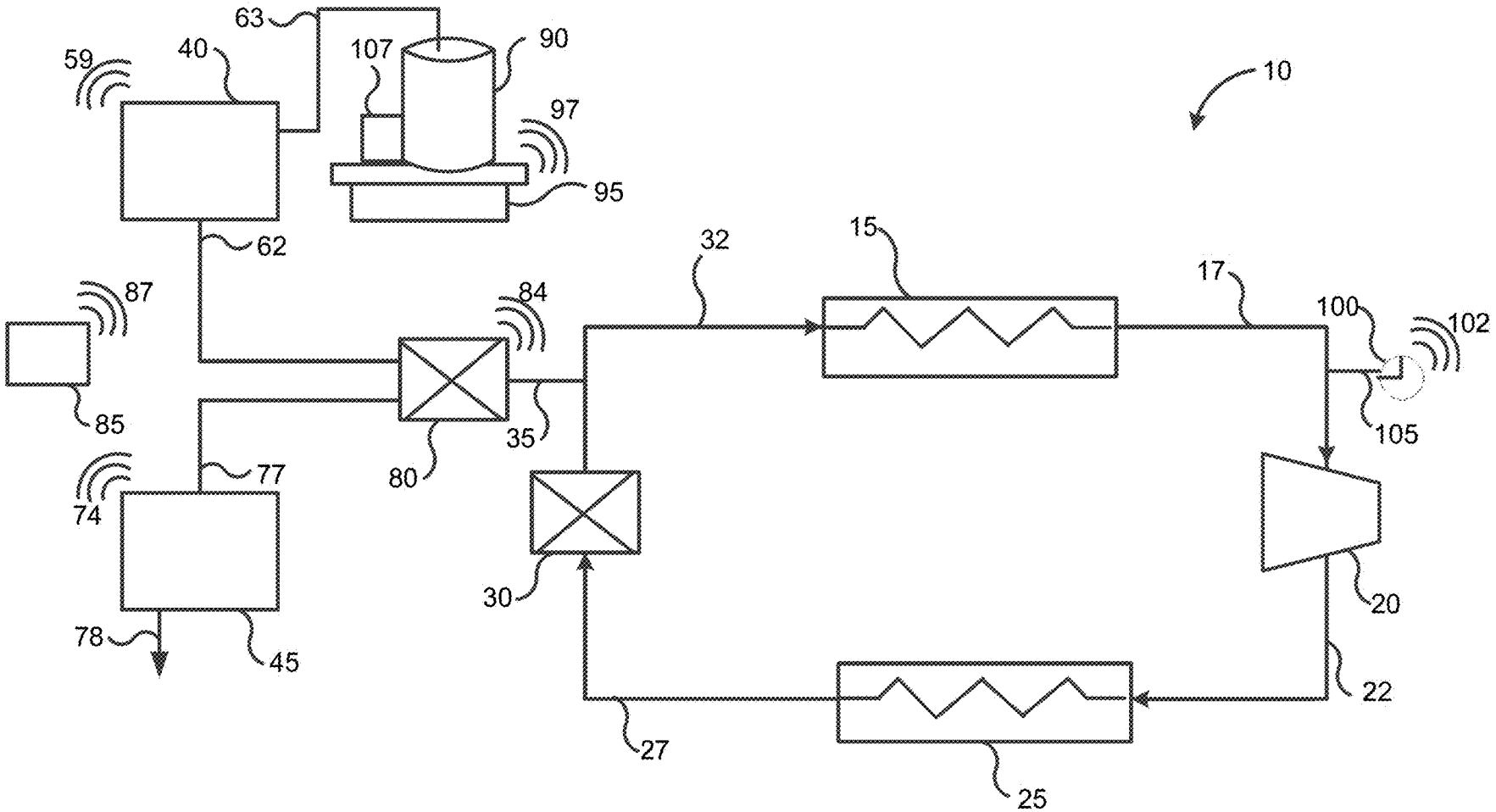
FIG. 1 is a schematic view of a system in accordance with an embodiment of the invention, including a recovery pump and a vacuum pump, connected to a refrigeration circuit.

With reference to FIG. 1, an air conditioning or refrigeration circuit 10 includes an evaporator 15, a compressor 20, a condenser 25, and an expansion valve 30. A refrigerant circulates through the refrigeration circuit 10, changing phases between liquid and vapor when passing through the evaporator 15 and the condenser 25. The circuit 10 schematically illustrates a typical vapor-compression refrigeration cycle commonly known by those of ordinary skill in the art. HVAC systems, such as the illustrated air conditioning circuit 10, are commonly found in residential properties, commercial properties, vehicles, and many other systems.

When maintenance is to be performed on the air conditioning circuit 10 of an HVAC system, each component 15, 20, 25, 30 and interconnecting conduit lines 17, 22, 27, 32 are first drained or emptied of any refrigerant. The air conditioning circuit 10 includes a port 35 to which a recovery pump 40 and a vacuum pump 45 may be alternately or concurrently coupled to allow the refrigerant to be removed from or introduced to the circuit 10. In some embodiments, the recovery pump 40 and the vacuum pump 45 are separate, individual components (FIG. 1), while in other embodiments, the recovery pump 40 and the vacuum pump 45 are integrated into a single housing or chassis such that the recovery pump 40 and the vacuum pump 45 may or may not be removably coupled to each other. Still, in other embodiments, the recovery pump 40 and the vacuum pump 45 may be integrated into a modular storage system, such as Milwaukee Tool's PACKOUT modular storage system.

Figure 2:
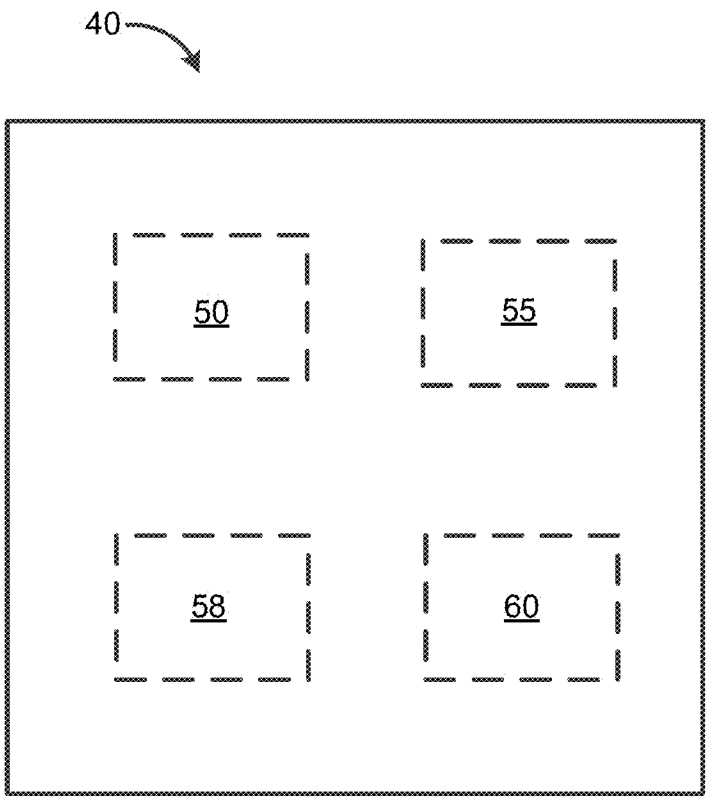
FIG. 2 is a schematic view of the recovery pump of FIG. 1.
Figure 4:
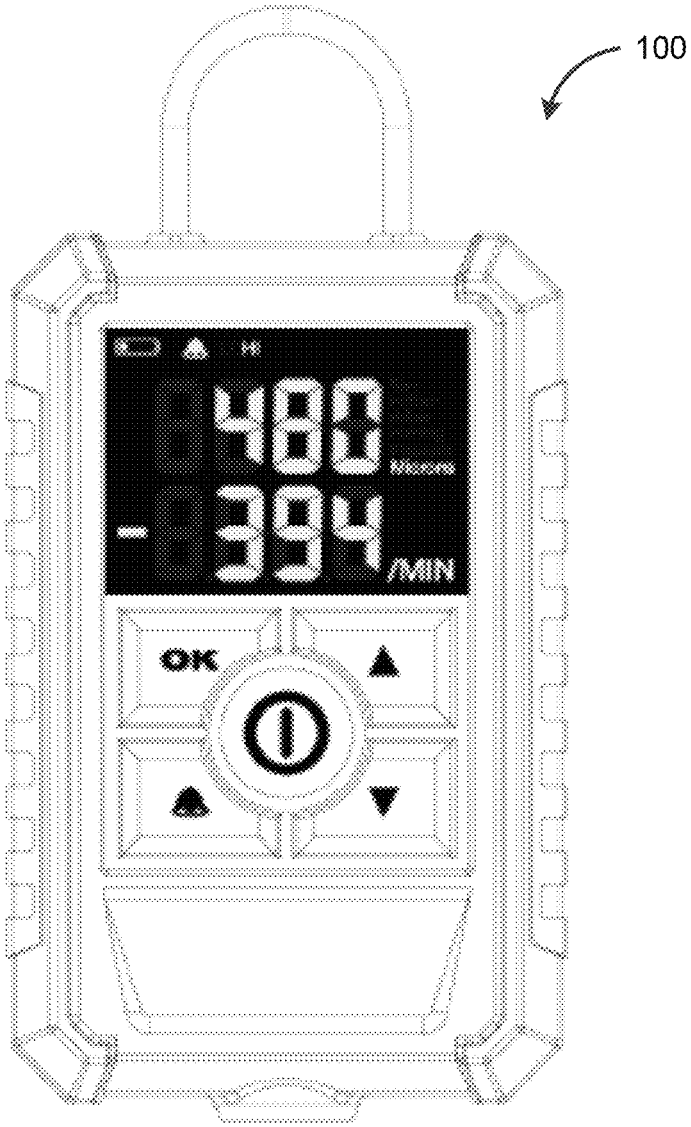
FIG. 4 is a plan view of a gauge pod for monitoring the pressure in the refrigeration circuit of FIG. 1.
Figure 5:
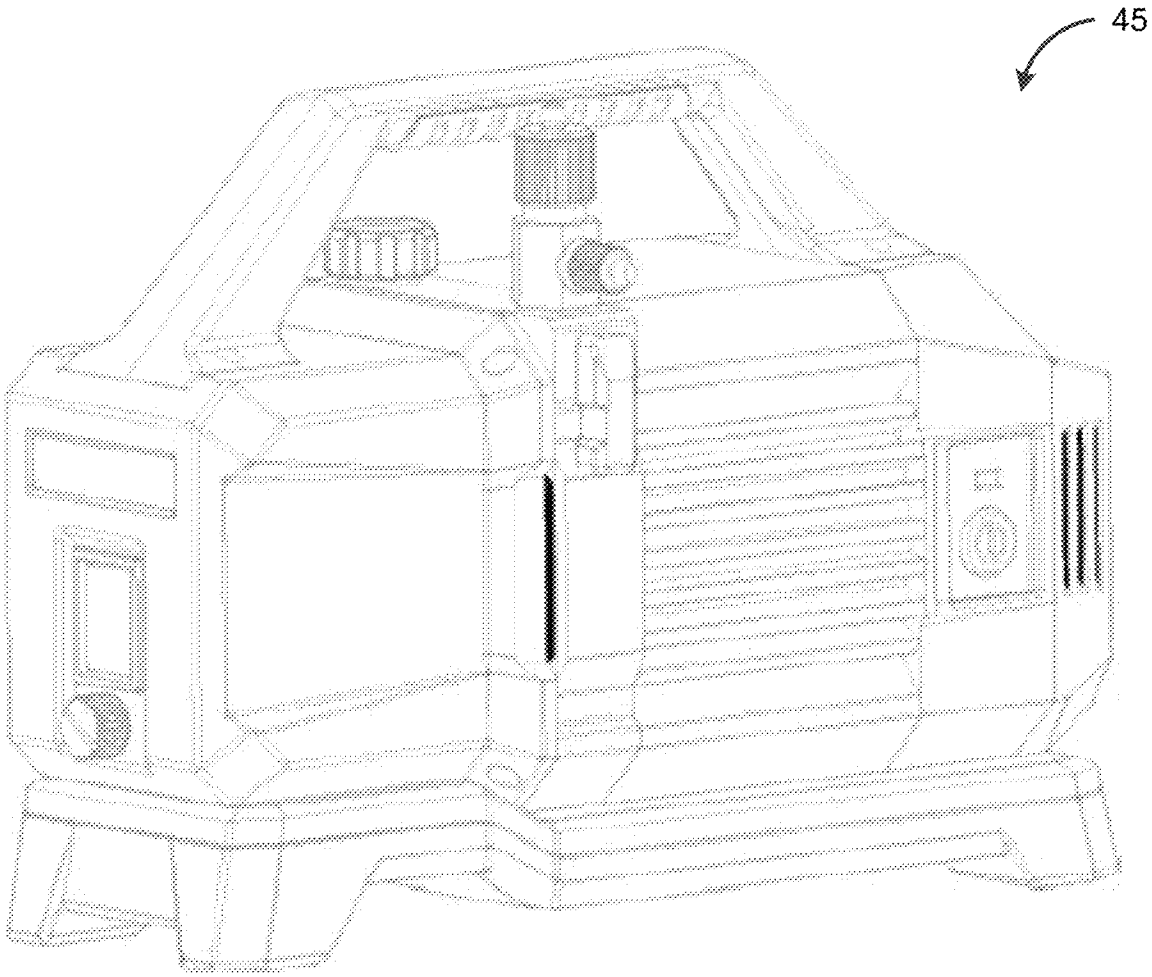
FIG. 5 is a perspective view of the vacuum pump of FIG. 1.

With reference to FIG. 2, the recovery pump 40 includes a motor 50, a pump 55 driven by the motor 50 that is operable to draw suction, and a controller 58 for controlling operation of the motor 50. The controller 58 includes a communication interface 59 for communicating with other system components, which are described below, that interface with the circuit 10. In the illustrated embodiment, the communication interface 59 is configured to send and receive a wireless signal, which is processed by the controller 58 and for sending an instruction and/or data to another system component interfacing with the circuit 10. The communication interface 59 may communicate with a network created between the recovery pump 40 and other system components interfacing with the circuit (e.g., using a cellular network, wide area network, local area network, etc.). The communication interface 59 may also allow the recovery pump 40 to directly communicate with other system components interfacing with the circuit, such as using a short-wave radio communication protocol (e.g., BLUETOOTH). In some embodiments, the communication interface of the controller 58 may be an electrical port to which an electrical cable or wire is attached for communication with various components of the circuit 10.

The pump 55 of the illustrated embodiment is a multi-stage rotary vane pump. The motor 50 is powered by an 18 volt Lithium-ion battery pack 60. In other embodiments, multiple battery packs 60 may be used to achieve a higher operating voltage (if used in series) or a higher capacity (if operating in parallel). In yet other embodiments, the battery pack 60 may include a different nominal voltage (e.g., 12 volts, 24 volts, 80 volts, etc.). In yet other embodiments, the recovery pump 40 may include a power cord for connection to an external power source (e.g., AC power through a wall outlet). The illustrated motor 50 is a brushless direct current (i.e., BLDC) motor. But, in other embodiments of the recovery pump 40, the motor 50 may be a brushed DC motor or an alternating current (i.e., AC) motor. The recovery pump 40 includes an inlet port 62 (FIG. 1) for drawing the refrigerant into the recovery pump 40 and an outlet port 63 for discharging the refrigerant from the recovery pump 40.

Figure 3:
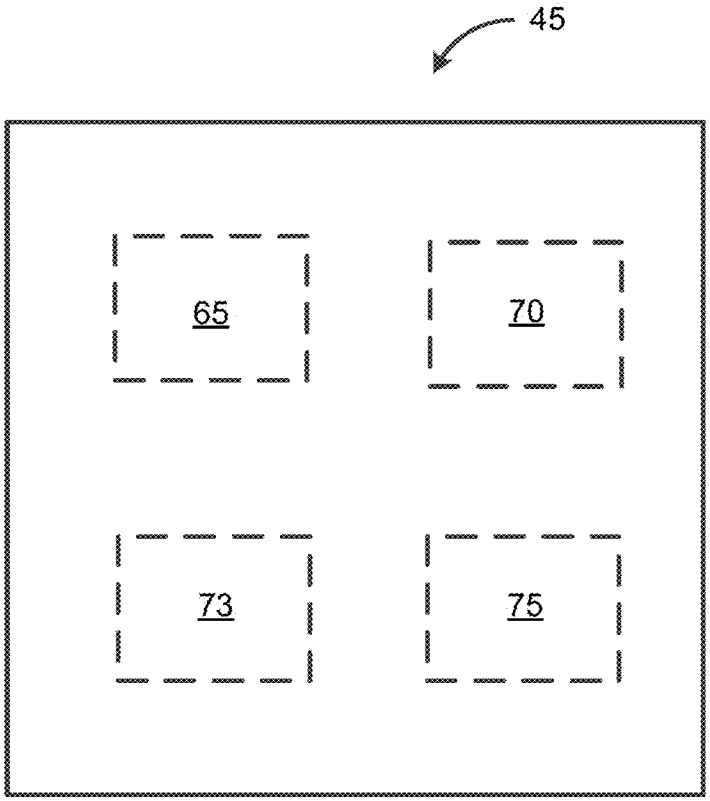
FIG. 3 is a schematic view of the vacuum pump of FIG. 1.

With reference to FIG. 3, the vacuum pump 45 includes a motor 65, a pump 70 driven by the motor 65 that is operable to draw suction, and a controller 73 for controlling operation of the motor 65. The controller 73 also includes a communication interface 74 for communicating with other system components, such as the recovery pump 40, that interface with the circuit 10. Like the communication interface 59 in the recovery pump 40, the communication interface 74 is configured to send and receive a wireless signal, which is processed by the controller 73 and for sending an instruction and/or data to another system component interfacing with the circuit 10. The communication interface 74 can indirectly communicate with the communication interface 59 in the recovery pump 40 over a network, as described above, or the communication interface 74 can directly communicate with the communication interface 59 in the recover pump 40 as described above. In some embodiments, the communication interface of the controller 73 may be an electrical port to which an electrical cable or wire is attached for communication with various components of the circuit 10.

The pump 70 of the illustrated embodiment is a rotary vane pump commonly known in the art. The motor 65 is powered by an 18 volt lithium-ion battery pack 75. In other embodiments, multiple battery packs 75 may achieve a higher voltage (if used in series) or a higher capacity (if operating in parallel). In yet other embodiments, the battery pack 75 may include a different nominal voltage (e.g., 12 volts, 24 volts, etc.). In yet other embodiments, the vacuum pump 45 may include a power cord for connection to an external power source (e.g., AC power through a wall outlet). The illustrated motor 65 is a brushless direct current (i.e., BLDC) motor. But, in other embodiments of the vacuum pump 45, the motor 65 may be a brushed DC motor or an alternating current (i.e., AC) motor. The vacuum pump 45 includes an inlet port 77 (FIG. 1) for drawing the refrigerant into the vacuum pump 45 and an outlet port 78 for discharging to atmosphere.

Figure 6:
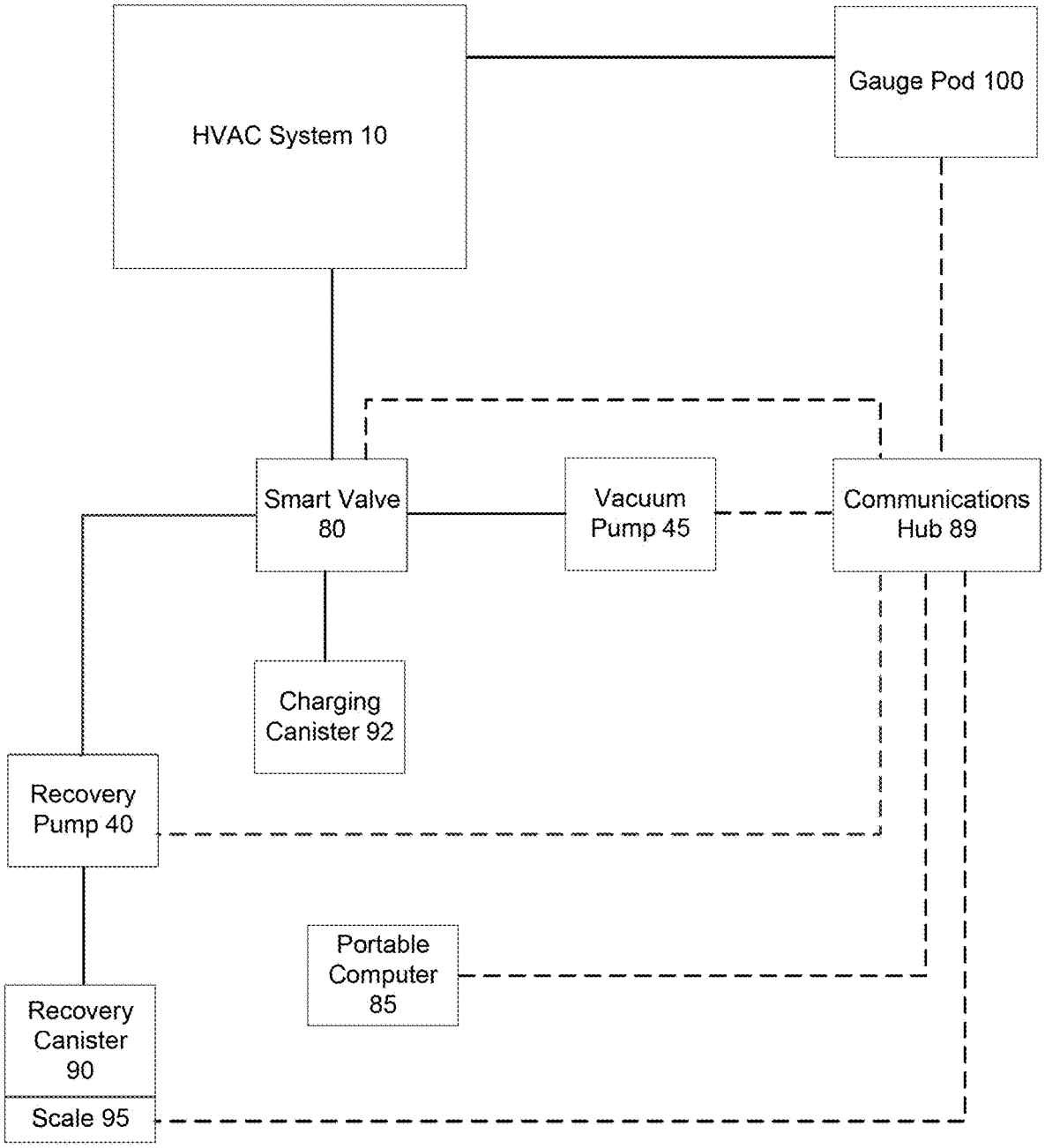
FIG. 6 is a schematic view of a system in accordance with another embodiment of the invention, including a recovery pump, a vacuum pump, and a communication hub 89, connected to a refrigeration circuit.

With reference to FIG. 1, each of the recovery pump 40 and the vacuum pump 45, through their respective communication interfaces 59, 74, can communicate with a mobile electronic device or portable computer 85 (e.g., a smart phone, a tablet, a remote controller, etc.) via a communication interface 87 in the portable computer 85. The communication interface 87 can indirectly communicate with the communication interfaces 59, 74 in the recovery pump 40 and the vacuum pump 45, respectively, over a network. For example, the communication interfaces 59, 74 may send wireless signals to a communication hub 89 (as indicated by dashed lines) that subsequently relays the wireless signals to the communication interface 87 of the portable computer 85, as shown in FIG. 6. In other embodiments, the communication interface 87 can directly communicate with the communication interfaces 59, 74 in the recovery pump 40 and the vacuum pump 45, respectively, through a wired connection. The portable computer 85 is capable of displaying, to a user remotely situated from the pumps 40, 45, one or more performance parameters of the pumps 40, 45 (e.g., power status, motor speed, battery level status, inlet and/or outlet port pressure and/or vacuum, service messages and/or warnings, total elapsed time, refrigerant levels, date and time, etc.) and/or one or more characteristic values of the circuit 10 (e.g., pressure, vacuum, etc.).

The portable computer 85 may also be used to transmit instructions, via the communication interface 87, to either of the controllers 58, 73 to remotely control the operation of the recover pump 40 and the vacuum pump 45, respectively.

Although not shown, in some embodiments, an electronic display may be provided on-board the recovery pump 40 and/or the vacuum pump 45 to communicate to a user one or more performance parameters of the pumps 40, 45 (e.g., power status, motor speed, battery level status, inlet and/or outlet port pressure and/or vacuum, service messages and/or warnings, total elapsed time, refrigerant levels, date and time, etc.) and/or one or more characteristic values of the circuit 10 (e.g., pressure, vacuum, etc.). Also, in some embodiments, the recovery pump 40 and/or the vacuum pump 45 may include on-board gauges to display the pressure (or vacuum) measured at the port 35 with a first gauge and the amount of refrigerant being discharged or introduced into the circuit 10 with a second gauge. The first and second gauges include a respective scale and level of precision to provide the user with proper accuracy.

With reference to FIG. 1, an accessory, such as an electrically actuated, multi-position "smart" valve 80, is fluidly connected to the port 35. The smart valve 80 includes an on-board controller, which has a communication interface 84 for wirelessly communicating with other system components, such as the recovery pump 40 and the vacuum pump 45, that interface with the circuit 10. In other embodiments, the communication interface 84 wirelessly communicates with the communication hub 89 (as indicated by dashed lines) that relays signals from the smart valve 80 to other system components, as shown in FIG. 6. The illustrated smart valve 80 is a two-position valve capable of selectively fluidly communicating either the recovery pump 40 or the vacuum pump 45 with the circuit 10 through the port 35. Specifically, the smart valve 80 of the illustrated embodiment is an electrically actuated (e.g., by a solenoid) valve that is operated by the on-board controller to alternate fluid communication between the recovery pump 40 and the vacuum pump 45 with the port 35. That said, the recovery pump 40 and the vacuum pump 45 are not capable of simultaneously being in fluid communication with the port 35. In other embodiments, the recovery pump 40 and the vacuum pump 45 each have separate smart valves 80 that are either at the respective inlet ports 62, 77 or are internal to each pump 40, 45. In other embodiments, the smart valve 80 may also measure flow rate of the refrigerant via a sensor (e.g., flowmeter, etc.) to be able to determine the amount of refrigerant contained in the canister 90.

With continued reference to FIG. 1, the recovery pump 40 is configured to be in fluid communication with a fluid recovery canister 90. The fluid recovery canister 90 defines an empty tank capable of receiving a volume of fluid or refrigerant. In the illustrated embodiment, the fluid recovery canister 90 is positioned on a measuring accessory or scale 95 that measures the weight of the fluid recovery canister 90 via a sensor (e.g., force gauge, load cell, etc.), which is indicative to the amount of refrigerant contained with the canister 90. The scale 95 also includes an on-board controller, which has a communication interface 97 for wirelessly communicating with other system components, such as the recovery pump 40 and the vacuum pump 45, that interface with the circuit 10 in the same manner as described above. In other embodiments, the communication interface 97 wirelessly communicates with the communication hub 89 (as indicated by dashed lines) that relays signals from the scale 95 to other system components, as shown in FIG. 6. Specifically, the scale 95 can communicate with the recovery pump 40 via its communication interface 59 for monitoring the amount of refrigerant in the canister 90. In some embodiments, the scale 95 is incorporated with the recovery pump 40 to form a single integrated unit. While in the illustrated embodiment the measuring device is a scale 95 for measuring weight, in other embodiments, the measuring device may alternatively measure flow rate of the refrigerant via a sensor (e.g., flowmeter, etc.) to be able to determine the amount of refrigerant contained in the canister 90. A charging canister 92, defining a refrigerant tank capable of filling the circuit 10, may be connected to the smart valve 80 directly (FIG. 6) once the fluid recovery canister 90 has recovered refrigerant from the circuit 10.

With continued reference to FIG. 1, another accessory, such as a gauge pod 100, is fluidly connected to the conduit line 17 and is capable of measuring the pressure (or vacuum) via a sensor (e.g., pressure transducer, etc.) in the conduit lines 17, 22, 27, 32 of the air conditioning circuit 10. As illustrated, the gauge pod 100 is fluidly connected to a port 105 of the conduit line 17 that is physically separate or disposed remotely from the port 35 where the recovery pump 40 and the vacuum pump 45 are connected. By locating the gauge pod 100 far away from the port 35, the total pressure detected by the gauge pod 100 is a more accurate reflection of static pressure in the lines 17, 22, 27, 32 of the circuit 10 because the effects of dynamic pressure of the flowing gas at or near the port 35 are minimized. The gauge pod 100 includes an on-board controller, which has a communication interface 102 for wirelessly communicating with other system components, such as the recovery pump 40 and the vacuum pump 45, that interface with the circuit 10 in the same manner as described above. In other embodiments, the communication interface 102 wirelessly communicates with the communication hub 89 (as indicated by dashed lines) that relays signals from the gauge pod 100 to other system components, as shown in FIG. 6.

The gauge pod 100 electronically communicates with the recovery pump 40 and the vacuum pump 45 by sending signals indicative of the pressure (or vacuum) measured by the gauge pod 100. Although the gauge pod 100 of the illustrated embodiment is in fluid communication with the conduit line 17, in other embodiments, the gauge pod 100 may alternatively be coupled to any of the conduit lines 17, 22, 27, 32 at a remote location from the port 35.

During operation, the refrigerant in the circuit 10 is first drained and collected prior to a user performing maintenance on the circuit 10. In order to do so, the user connects the smart valve 80 to the port 35, the gauge pod 100 to the port 105, and the recovery pump 40 and the vacuum pump 45 to the smart valve 80, as indicated by step 140 of FIG. 9. Subsequently, the recovery pump 40 and the vacuum pump 45 are connected with the smart valve 80 via the dual inlets ports 62, 77. Once activated, the recovery pump 40, the vacuum pump 45, the smart valve 80, the scale 95, and the gauge pod 100 electronically communicate with each other, via the respective communication interfaces 59, 74, 84, 97, 102 or through the communication hub 89, and assume a "ready" state. The state of each of these components can be communicated to the user via the portable computer 85. When the user is ready to recover the refrigerant from the circuit 10, the user may initiate operation of the recovery pump 40 by sending an instruction to the controller 58 with the portable computer 85, as indicated by step 142. Alternatively, the user may initiate operation of the recovery pump 40 by manipulating controls on a control panel on-board the recovery pump 40.

The smart valve 80 is actuated to place the recovery pump 40 in fluid communication with the circuit 10 and activates the motor 50 (and therefore the pump 55) of the recovery pump 40 to remove refrigerant from the circuit 10 when the recovery pump 40 in a fluid removal state. The refrigerant that is being removed from the circuit 10 travels through the port 35, the smart valve 80, the inlet port 62 of the recovery pump 40, discharged through outlet port 63, and is then stored and collected in the fluid recovery canister 90, thus increasing the weight of the canister 90. The recovery pump 40 is configured to detect the type of or characteristics of the refrigerant being removed (e.g., ASHRAE Number R134a, R32, R410a, etc.) during collection of the refrigerant via a sensor (e.g., viscosity sensor). In other embodiments, the user manually selects/inputs the type of refrigerant being used in the circuit 10 with a selector knob, a digital display, or other means. The scale 95 upon which the canister 90 is disposed monitors the weight of the canister 90 and sends a signal to the recovery pump controller 58 indicative of the weight of the canister 90. In one embodiment, when the controller 58 detects that the weight of the canister 90 has reached a maximum weight threshold, the controller 58 stops the motor 50 (and therefore the pump 55), discontinues the transfer of the refrigerant into the canister 90, and begins transferring the refrigerant into an alternate canister (not shown). In other embodiments, the controller 58 deactivates the motor 50 and the pump 55 when the weight of the canister 90, as communicated by the scale 95, has reached the maximum weight threshold.

Figure 7A:
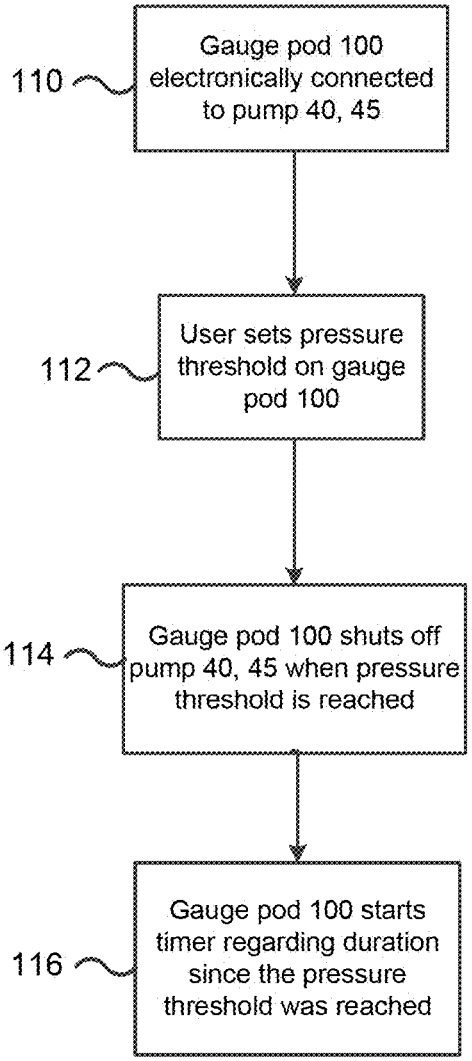
FIG. 7A is a flow chart illustrating operation of the gauge pod and the vacuum pump of FIGS. 4 and 5, respectively.
Figure 7B:
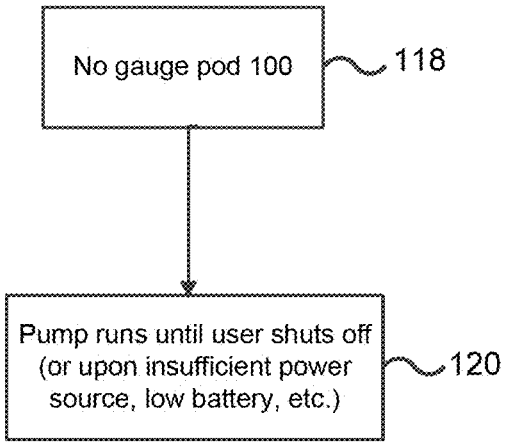
FIG. 7B is a flow chart illustrating operation of the vacuum pump of FIG. 5 without the gauge pod.

Meanwhile, as indicated by step 110 of FIG. 7A, the gauge pod 100 is also sending signals to the recovery pump controller 58 for monitoring the pressure within the circuit 10 (e.g., conduit lines 17, 22, 27, 32) when the refrigerant is being recovered into the canister 90. The gauge pod 100 compares the pressure within the circuit 10 with the pressure threshold set by the user, as indicated by step 112. When the gauge pod 100 sends a signal to the recovery pump controller 58 indicative that the pressure in the circuit 10 has reached or dropped below a pressure threshold, the recovery pump 40 is deactivated, as indicated by step 114. The recovery pump 40 may be deactivated due to the pressure threshold being reached even though the maximum weight threshold has not been reached. Once the pressure threshold has been reached, the gauge pod 100 begins a timer to count the duration since the pressure threshold was reached, as indicated by step 116. If the gauge pod 100 is not electrically connected to the recovery pump controller 58, as indicated by step 118 of FIG. 7B, then the recovery pump 40 runs until the user deactivates the recovery pump 40, as indicated by step 120.

Figure 9:
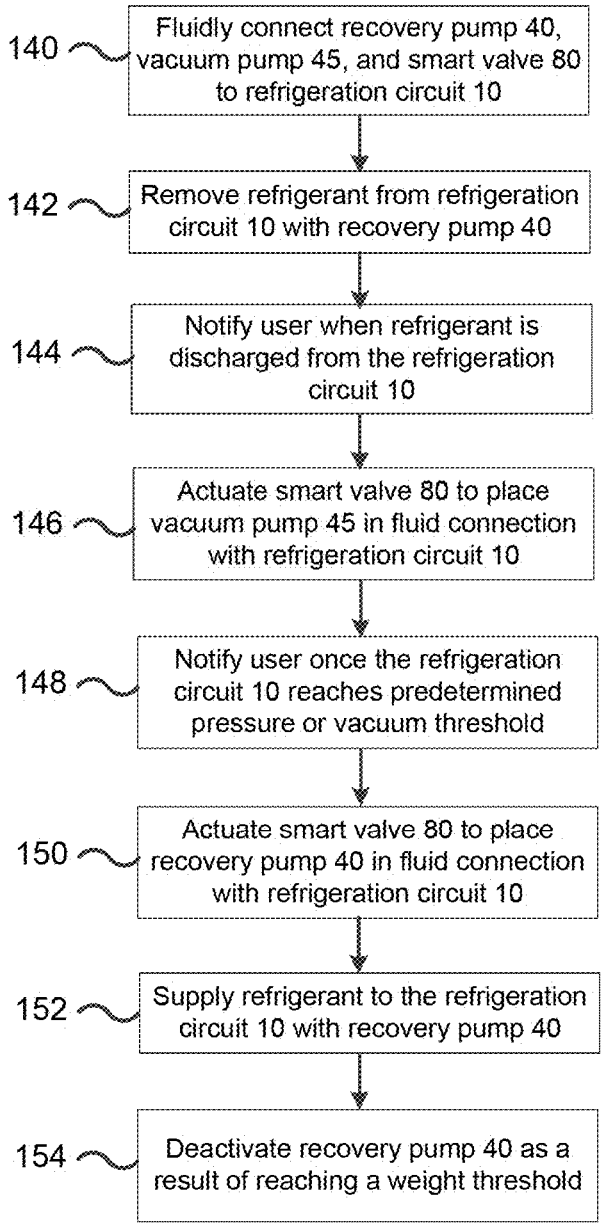
FIG. 9 is a flow chart illustrating a control scheme for the system of FIG. 1 while performing work on the refrigeration circuit of FIG. 1.

Once the recovery pump 40 is deactivated in response to either the maximum weight threshold or the pressure threshold, an indication is provided to the user through either the on-board electronic display or the portable computer 85, as indicated by step 144 of FIG. 9. Such an indication may be, for example, tactile (e.g., vibration), audible (e.g., a warning tone or beeps), visual (e.g., a warning light), or a combination thereof. Generally, the indication is indicative that the refrigerant has been recovered from the air conditioning circuit 10, as indicated by step 122, and that the user is allowed to service or perform maintenance on the circuit 10, as indicated by step 124. Occasionally, the canisters 90, 92 need to be changed prior to the completion of emptying or filling the circuit 10, as indicated by step 126. Other indications may also be provided to the user for monitoring various performance parameters during operation. For example, an indication may be provided to the user when the battery 60 has reached or drops below a charge threshold. In response to the charge threshold of the battery 60 being reached, the controller 58 is configured to deactivate the motor 50 and close the smart valve 80 to seal the circuit 10 from ingress of contaminants. In other embodiments, a biased-closed valve is provided that seals the circuit. In another embodiment, a capacitive circuit is provided that stores a charge sufficient to power a valve to close and seal the circuit once the charge threshold is reached. Also, an indication may be provided to the user, through either the on-board electronic display or the portable computer 85, when the motor 50 reaches a load threshold. In this case, the indication of the load threshold being reached may be indicative of an issue with the recovery pump 40 or that the recovery pump 40 may need servicing (e.g., oil change, low oil, etc.). Further, an indication may be provided to the user, through either the on-board electronic display or the portable computer 85, when a potential leak is detected. In response to a potential leak being detected, the recovery pump 40 enters a leak detection mode, as indicated by step 128, where the recovery pump 40 deactivates for a predetermined time period. Once the predetermined time period has elapsed, the recovery pump 40 measures the pressure in the circuit 10, as indicated by step 130, and compares the measured pressure to the pressure in the circuit 10 upon entering the leak detection mode. If the pressure changed throughout the predetermined time period, as indicated by step 130, the recovery pump 40 indicates to a user, through either the on-board electronic display or the portable computer 85, that there is a leak in the system. In one embodiment, the vacuum pump 45 and/or recovery pump 40 will send, e.g., wirelessly transmit, a notification to a user, e.g., to a user's smartphone or other wireless device. In other embodiments, the controller 58 of the recovery pump 40 may alternatively close the smart valve 80 upon the recovery pump 40 entering the leak detection mode.

Upon completion of the maintenance on the circuit 10, the user may perform a gas purge of the circuit 10, as indicated by step 128. In one embodiment, the recovery pump controller 58 initiates release of Nitrogen or other gas into the circuit 10 to purge the circuit 10 of contaminants (e.g., moisture). The majority of the contaminants are removed from the circuit 10 upon completion of the Nitrogen purge and the run cycle of the recovery pump 40.

Following the Nitrogen (or other gas) purge, the smart valve 80 is controlled (by one of the controllers 58, 73) to place the vacuum pump 45 in fluid communication with the circuit 10, as indicated by step 146 of FIG. 9. Thereafter, the vacuum pump controller 73 activates the motor 65 (and therefore the pump 70) to draw a deep vacuum in the circuit 10 to remove gas (e.g., air) and any contaminants (e.g., moisture, etc.) remaining in the circuit 10. The gauge pod 100 monitors the pressure in the circuit 10 once the vacuum pump 45 is activated. When the gauge pod 100 sends a signal to the controller 73 indicative that the pressure in the circuit 10 has reached a predetermined pressure (in this instance, vacuum) threshold, the vacuum pump 45 is deactivated and the smart valve 80 may be closed, as indicated by step 148. In some embodiments, the vacuum threshold is the same regardless of which pump 40, 45 is running, whereas in other embodiments, the pressure threshold is different depending which pump 40, 45 is running.

The same performance parameters of the vacuum pump 45 and characteristic values of the circuit 10 that were monitored during activation of the recovery pump 40, as described above, may also be monitored while the vacuum pump 45 is activated. A corresponding indication (e.g., tactile, audible, visual, etc.) is provided to the user, through either an electronic display on-board the vacuum pump 45 or the portable computer 85, in response to any of the performance parameters and/or characteristic values of the circuit reaching a predetermined threshold during operation of the vacuum pump 45.

Figure 8:
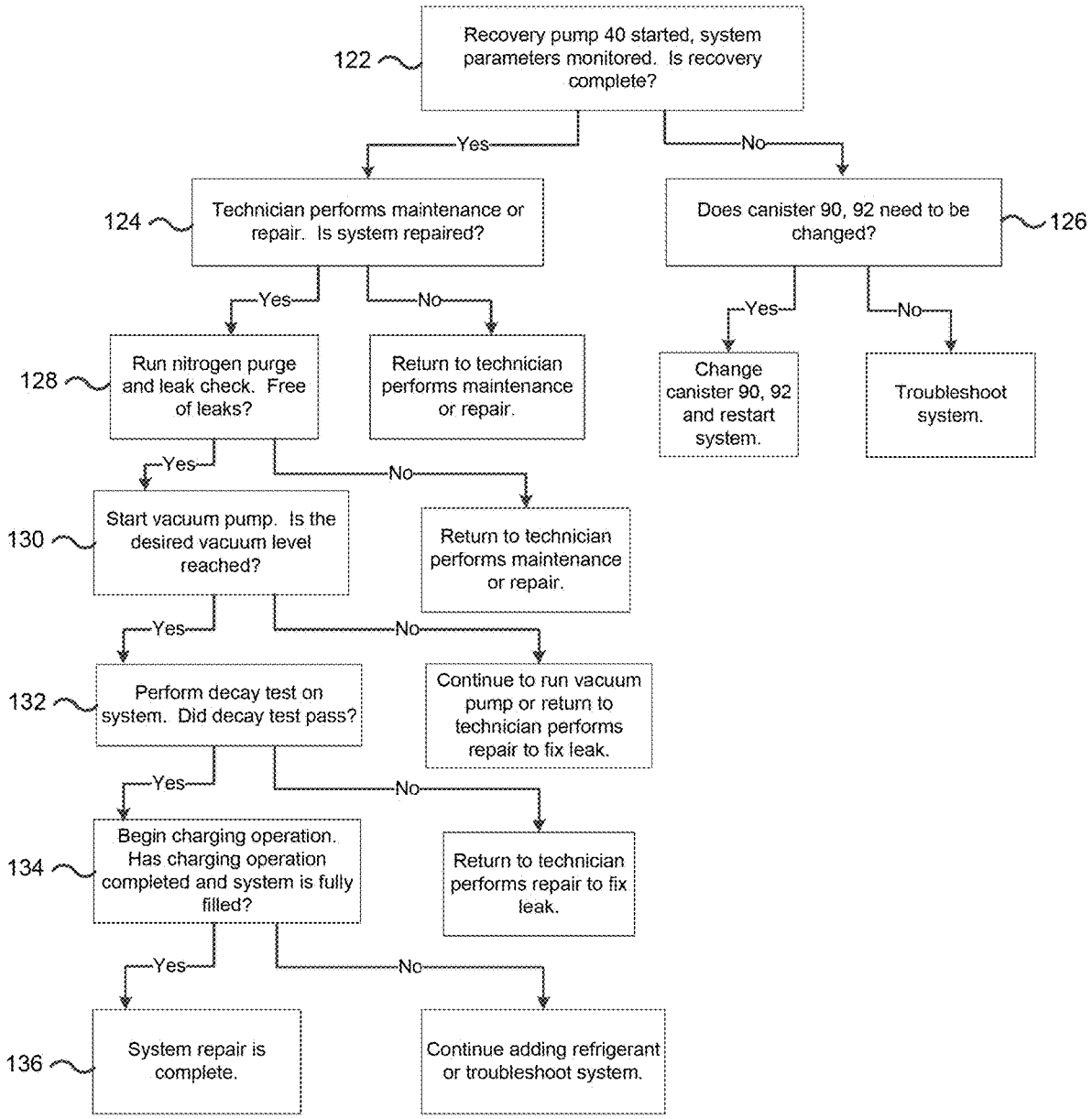
FIG. 8 is a flow chart illustrating an operation for performing work on the refrigeration circuit of FIG. 1 using the system of FIG. 1.

Once the vacuum pump 45 evacuates the circuit 10 and the user is prompted to confirm proceeding to the next step, the smart valve 80 is instructed (through a signal received from one of the controllers 58, 73) to place the recovery pump 40 in fluid communication with the circuit 10, and the recovery pump controller 58 re-activates the motor 50 and the pump 55, as indicated by step 150 of FIG. 9. This time, however, the recovery pump 40 introduces (i.e., pumps) refrigerant into the circuit 10 through the outlet port 63 when the recovery pump 40 in a fluid supply state, as indicated by step 134 of FIG. 8 and step 152 of FIG. 9. In one embodiment, the refrigerant that was previously removed from the circuit 10 is reintroduced into the circuit 10. In other embodiments, a new fluid or refrigerant from a new canister (charging canister 92) on the scale 95 is introduced into the circuit 10. When the scale 95 determines that a weight of the charging canister 92 or the collection canister 90 has reached a minimum weight threshold (e.g., indicative that the refrigerant has been pumped into the circuit 10) the controller 58 deactivates the recovery pump 40. An indication (e.g., tactile, audible, visual, etc.) is provided to the user that the weight threshold has been reached (as indicated by step 154 of FIG. 9), through either the electronic display on-board the recover pump 40 or the portable computer 85, to indicate that the circuit 10 has been refilled with the refrigerant and the process is complete, as indicated by step 136 of FIG. 8.

As refrigerant is introduced into the circuit 10, the canister 90, 92 becomes cold due to the expansion process of the refrigerant exiting the canister 90, 92. Heating the canister 90, 92 during this time is beneficial to assist in the introduction process of the refrigerant. Thus, a heater 107, such as a hot plate or a warming blanket may be provided on the scale 95 to heat the canister 90. In other embodiments, the heater 107 may be an exhaust fan provided adjacent the scale 95 that blows hot air exhausted from the motor 50 across the canister 90.

Accordingly, each of the recovery pump 40 and the vacuum pump 45 can communicate with each other to receive information therefrom and to automatically control the operation of various accessories interfacing with the air conditioning circuit 10, such as (in addition to the pumps 40, 45) the smart valve 80, the scale 95, the gauge pod 100. Thus, only minimal input is required from the user, through either an electronic display on-board the pumps 40, 45 or the portable computer 85, to initiate a refrigerant recovery, conduit evacuation, and refrigerant replacement processes.

Various features of the invention are set forth in the following claims.

What is claimed is:

1. A system attachable to a refrigeration circuit, the system comprising:

a recovery pump attachable to the refrigeration circuit to remove refrigerant therefrom, the recovery pump including a pump, an electric motor for driving the pump, a battery pack for providing power to the electric motor, and a recovery pump controller for controlling the operation of the electric motor, the recovery pump controller having a first communication interface; and an accessory attachable to the refrigeration circuit concurrently with the recovery pump, the accessory including a sensor for detecting a characteristic value of the refrigeration circuit, and an accessory controller electrically connected with the sensor to receive a signal therefrom corresponding with the characteristic value of the refrigeration circuit, the accessory controller having a second communication interface to communicate the signal to the recovery pump controller via the first and second communication interfaces, wherein the recovery pump controller is operable to control the operation of the electric motor based upon the signal received from the accessory;

wherein the pump is operable in a fluid removal state, in which the pump removes the refrigerant from the refrigeration circuit when the electric motor is activated, and in a fluid supply state, in which the pump supplies the refrigerant to the refrigeration circuit when the electric motor is activated.

2. The system of claim 1, wherein the recovery pump further comprises a recovery pump sensor disposed proximate at least one of a fluid inlet or a fluid outlet for detecting a type of the refrigerant during the fluid removal state.

3. The system of claim 1, wherein the accessory includes an electrically actuated fluid valve coupled between the pump and the refrigeration circuit to selectively place the pump in fluid communication with the refrigeration circuit.

4. The system of claim 3, wherein the electrically actuated fluid valve is actuated to place the pump in fluid communication with the refrigeration circuit, and wherein the electrically actuated fluid valve activates the electric motor to remove the refrigerant from the refrigeration circuit during the fluid removal state.

5. The system of claim 1, further including a collection canister that is in fluid communication with the pump for storing the refrigerant extracted from the refrigeration circuit during the fluid removal state.

6. The system of claim 5, wherein the accessory includes a measuring accessory that is a scale to measure the weight of the refrigerant stored in the collection canister from the refrigeration circuit.

7. The system of claim 6, wherein the accessory controller is configured to transmit the signal to the recovery pump controller to deactivate the electric motor in response to the measuring accessory detecting that the collection canister has reached a maximum weight threshold.

8. The system of claim 7, wherein the accessory controller is configured to transmit the signal to a portable computer indicating to a user that the maximum weight threshold has been reached.

9. The system of claim 7, wherein the accessory controller is configured to transmit the signal to the recovery pump controller to reactivate the electric motor for supplying the refrigeration circuit with the refrigerant from the collection canister during the fluid supply state.

10. The system of claim 9, further comprising a heater for increasing the temperature of the collection canister during the fluid supply state.

11. The system of claim 10, wherein the heater is a resistive heating element coupled to the collection canister.

12. The system of claim 1, wherein the accessory includes a gauge accessory that is attachable to the refrigeration circuit and is disposed remotely from the recovery pump.

13. The system of claim 12, wherein the accessory controller is configured to transmit the signal to the recovery pump controller indicative of the pressure within the refrigeration circuit proximate the gauge accessory.

14. The system of claim 13, wherein the pump is deactivated in response to the signal received from the accessory controller corresponding to the pressure in the refrigeration circuit being equal or below a pressure threshold.

15. The system of claim 1, wherein the battery pack is a Lithium-ion battery pack.

16. The system of claim 1, further comprising an electronic display for communicating to the user at least one of a performance parameter of the recovery pump or a characteristic value associated with the refrigeration system.

17. The system of claim 1, wherein the performance parameter includes a load value of the electric motor.

18. The system of claim 1, wherein the first communication interface of the recovery pump controller is a first wireless interface and the second communication interface of the accessory controller is a second wireless interface.

19. A system attachable to a refrigeration circuit, the system comprising:

a pump assembly attachable to the refrigeration circuit, the pump assembly including a pump, an electric motor for driving the pump, and a pump controller for controlling the operation of the electric motor, the pump controller having a first communication interface;

an accessory attachable to the refrigeration circuit concurrently with the pump assembly, the accessory including a sensor for detecting a characteristic value of the refrigeration circuit, and an accessory controller electrically connected with the sensor to receive a signal therefrom corresponding with the characteristic value of the refrigeration circuit, the accessory controller having a second communication interface; and a communication hub configured to receive the signal from the second communication interface of the accessory and transmit the signal to the pump controller via the first communication interface, wherein the pump controller is operable to control the operation of the electric motor based upon the signal received from the communication hub;

wherein the pump assembly is operable in a fluid removal state, in which the pump removes a fluid from the refrigeration circuit when the electric motor is activated, and in a fluid supply state, in which the pump supplies the refrigerant to the refrigeration circuit when the electric motor is activated.

20. The system of claim 19, further comprising an electrically actuated fluid valve coupled between the pump assembly and the refrigeration circuit to selectively place the pump assembly in fluid communication with the refrigeration circuit.

21. The system of claim 20, wherein the electrically actuated fluid valve includes a controller with a communication interface for communicating with the vacuum pump.

22. The system of claim 20, wherein the electrically actuated fluid valve is actuated to place the pump assembly in fluid communication with the refrigeration circuit, and wherein the electrically actuated fluid valve activates the electric motor to remove the fluid from the refrigeration circuit and discharge the fluid to atmosphere during the fluid removal state.

23. The system of claim 19, wherein the pump controller is configured to communicate with a portable computer via the first communication interface to transmit a performance parameter of the pump assembly to the user and to receive instructions inputted by the user to remotely control operation of the pump assembly.

24. The system of claim 19, further comprising a battery pack for providing power to the electric motor.

25. The system of claim 19, further comprising an electronic display for communicating to the user at least one of a performance parameter of the pump assembly or a characteristic value associated with the refrigeration circuit.

26. The system of claim 25, wherein the performance parameter includes a load value of the electric motor.

27. The system of claim 19, wherein the first communication interface of the vacuum pump controller is a first wireless interface and the second communication interface of the accessory controller is a second wireless interface.

* * * * *